US005705469A

United States Patent [19]

Blake et al.

[11] Patent Number: 5,705,469

[45] Date of Patent: Jan. 6, 1998

[54] PROCESS FOR THE MANUFACTURE OF A LIQUID DETERGENT COMPOSITION COMPRISING A SULPHITING AGENT AND AN ENZYME SYSTEM

[75] Inventors: Alan David Blake, Overijse; Jozef Philemona R. Geudens, Asse; Paul Andrew Hardy, Overijse; Fabrice Francois J. Questel, Brussels, all of Belgium

[73] Assignee: The Procter & Gamble Company, Cincinnati, Ohio

[21] Appl. No.: 428,158

[22] PCT Filed: Oct. 1, 1993

[86] PCT No.: PCT/US93/09390

§ 371 Date: Apr. 20, 1995

§ 102(e) Date: Apr. 20, 1995

[87] PCT Pub. No.: WO94/10283

PCT Pub. Date: May 11, 1994

[30] Foreign Application Priority Data

Oct. 28, 1992 [EP] European Pat. Off. ..... 92870177

[51] Int. Cl.[6] ..... C11D 3/02; C11D 3/386

[52] U.S. Cl. ..... 510/392; 510/530; 510/494

[58] Field of Search ..... 252/174.12, DIG. 12, 252/105, 174, DIG. 14; 510/392, 530, 494

[56] References Cited

U.S. PATENT DOCUMENTS

| | | | |
|---|---|---|---|
| 3,683,939 | 8/1972 | Johnson et al. | 132/7 |
| 3,741,901 | 6/1973 | Ziffer | 252/89 |
| 3,773,671 | 11/1973 | Hussain | 252/89 |
| 3,940,341 | 2/1976 | Gray et al. | 252/105 |
| 4,707,287 | 11/1987 | Herdeman | 252/91 |
| 4,767,557 | 8/1988 | Herdeman | 252/91 |
| 5,093,021 | 3/1992 | Coyne et al. | 252/91 |
| 5,256,557 | 10/1993 | Shetty et al. | 435/222 |
| 5,439,817 | 8/1995 | Shetty et al. | 435/222 |

FOREIGN PATENT DOCUMENTS

| | | | |
|---|---|---|---|
| 62-57492 | 3/1987 | Japan . | |
| 1-256596-A | 10/1989 | Japan | C11D 3/38 |

*Primary Examiner*—Paul Lieberman
*Assistant Examiner*—Kery A. Fries
*Attorney, Agent, or Firm*—K. W. Zerby; J. J. Yetter; J. C. Rasser

[57] ABSTRACT

A process is disclosed for the manufacture of a liquid detergent composition comprising a sulphiting agent and an enzyme system. Said enzyme system and said sulphiting agent interact together so as to generate odors which result in an odor deviation in said detergent composition. In the process of the invention, said enzyme system and said sulphiting agent are intimately mixed together separately from the remainder of the detergent composition so as to generate said odors outside the remainder of said detergent composition. Also disclosed is an enzyme premix consisting essentially of said enzyme system and said sulphiting agent.

9 Claims, No Drawings

PROCESS FOR THE MANUFACTURE OF A LIQUID DETERGENT COMPOSITION COMPRISING A SULPHITING AGENT AND AN ENZYME SYSTEM

TECHNICAL FIELD

The present invention relates to the manufacture of liquid detergent compositions which comprise a sulphiting agent and an enzyme system.

BACKGROUND

Liquid detergents have been described extensively in the art. In applicants' co-pending European patent application 91870175.6 liquid laundry detergents are described which comprise a sulphiting agent that stabilizes the color characteristics of said compositions.

A new technical problem has occurred upon using sulphiting agents in liquid detergents in that important odors are generated as the sulphiting agent is incorporated in said detergents, so that said detergent's odor significantly deviates from its defined standard. The problem the present invention seeks to solve is to avoid odor deviations in liquid laundry detergents which comprise sulphiting agents.

In response to this technical problem, applicants have found that said odor deviation is generated by an interaction between the sulphiting agent and the enzyme which is also present in said detergent. Without wanting to be bound by theory, it is believed that the sulphiting agent reacts with impurities which are typically present in commercially available enzyme preparations.

Thus to avoid odor deviations in a liquid detergent comprising an enzyme system and a sulphiting agent, the present invention proposes to intimately mix said enzyme system and said sulphiting agent apart from the remainder of said detergent composition.

Liquid detergent compositions comprising sulphiting agents have been described in DE 3729474, EP 80 748, EP 80 223, EP 79641, BE 796 115 and U.S. Pat. No. 3,741,901. None of these documents suggest that enzymes and sulphiting agents may generate odor if they are mixed together. Furthermore, J01256596 (abstract) addresses the control of enzyme-originating odors. In the context of this document, sulphites are used to diminish the odor of enzymes.

SUMMARY OF THE INVENTION

The present invention includes a process for the manufacture of a liquid detergent composition comprising a sulphiting agent and an enzyme system, whereby said enzyme system and said sulphiting agent interact together so as to generate odors, characterized in that said process includes the steps of:

- intimately mixing said enzyme system and at least a portion of said sulphiting agent separately from the remainder of said detergent composition so as to generate said odor outside the remainder of said detergent composition, and
- leaving said sulphiting agent and said enzyme system to interact in such conditions and until said odor has disappeared or is substantially reduced, and
- thereafter adding said intimate mixture of said sulphiting agent and said enzyme system to the remainder of said detergent composition.

The present invention further includes an enzyme premix obtainable in the course of the process according to the present invention, said enzyme premix consisting essentially of said enzyme system and said sulphiting agent.

DETAILED DESCRIPTION OF THE INVENTION

The present invention concerns the manufacture of liquid detergent composition. Liquid detergent compositions manufactured according to the present invention comprise conventional detergency ingredients, an enzyme system and a sulphiting agent.

As used herein, conventional detergency ingredients include such ingredients as surfactants, builders, bleaches, solvents, soil release agents, color care ingredients, chelants, dyes, perfumes and the like. The detergent compositions herein may be aqueous or anhydrous, and can further be formulated as so-called concentrated liquid detergent compositions. The detergent compositions according to the present invention can be formulated in a variety of different embodiments, especially laundry detergents.

The compositions manufactured according to the present invention further comprise a sulphiting agent. As used herein, sulphiting agents are compounds capable of yielding sulfite ions in said liquid detergent compositions. Such sulphiting agents include sulphite, hydrogenosulphite or pyrosulphite salts, sulfur dioxide and sulfurous acid, or mixtures thereof. Preferred for use herein are alkali metal sulphites, pyrosulphite or hydrogenosulphite, particularly potassium sulphites. The compositions manufactured according to the present invention comprise from 0.01% to 1% by weight of said total composition of said sulphiting agent, preferably from 0.05% to 0.7%, most preferably from 0.1% to 0.5%. As used herein, the term sulphiting agents includes mixtures of sulphiting agents.

The compositions manufactured according to the present invention further comprise an enzyme system. Said enzyme system includes protease, amylase, cellulase and lipase. As used herein, the term enzyme system includes single enzymes and mixtures thereof. Most commercially available enzymes come as preparations which comprise pure enzyme and impurities. It is believed that said impurities interact with the sulphiting agents to generate odors. Accordingly, the term "enzyme" as used herein refers to the enzyme together with the impurities which come with it. The present invention is only applicable to those enzymes, or enzyme preparations, which generate odors as they are intimately mixed with a sulphiting agent as described hereinabove. Such enzymes include commercially available Termamyl® and Maxamyl®. Detergent compositions manufactured according to the present invention comprise from 0.1% to 10% by weight of said enzyme system, preferably from 0.2% to 5%, most preferably from 0.5% to 3%.

The process according to the present invention comprises at least three steps.

In the first of these three steps, said sulphiting agent and said enzyme system are intimately mixed together apart from the remainder of said liquid detergent composition. As a result, during this first step said odor is generated outside the remainder of the detergent composition as said sulphiting agent and said enzyme system are intimately mixed together. By "intimately mixed" it is to be understood that said sulphiting agent and said enzyme system are mixed so as to ensure complete interaction between both ingredients, thus complete generation of said odor. In the present invention, it is possible to mix said enzyme system with the totality of the sulphiting agent to be formulated in the detergent composition, or only a portion thereof. In any case, said enzyme system must be intimately mixed with at least a portion of said sulphiting agent, wherein said portion of sulphiting agent represents a quantity which is sufficient to ensure complete generation of said odor. In practice, it has been noted that a very small quantity of sulphiting agent (see description of premix hereinafter) is required to completely generate said odor.

In the second step of the process according to the present invention, said sulphiting agent and said enzyme system are left to interact in appropriate conditions and until said odor has disappeared or is substantially reduced. In practice it appears sufficient to gently mix both ingredients under adequate aeration.

In the third step of the process according to the present invention, said intimate mixture of said sulphiting agent and said enzyme system is added to the remainder of said liquid detergent composition. It is to be understood that said intimate mixture can also be added to a portion of the remainder of said liquid detergent composition, which in turn may be added to a further portion of said liquid detergent composition or the remainder thereof.

The present invention further includes an enzyme premix obtainable in the course of the process according to the present invention. Said premix consists essentially of said enzyme or mixtures thereof and said sulphiting agent or mixtures thereof. By "subtantially", it is meant herein that said premix also comprises impurities which come with the enzyme raw material and which interact with said sulphiting agent. Said premix preferably comprises from 0.1% to 5% by weight of said premix of said sulphiting agent, preferably from 0.1% to 1% by weight, the remainder of said premix being constituted by the enzyme raw material.

The present invention is further illustrated by the following example.

EXAMPLE

A liquid detergent composition is made which comprises the listed ingredients in the listed proportions (weight %):

| | |
|---|---|
| Linear Alkyl Benzene sulphonate | 19.00 |
| Nonionic surfactant | 12.00 |
| Fatty acid | 11.00 |
| Citric acid | 5.00 |
| Termamyl ® (1) | 0.14 |
| Potassium sulphite | 0.13 |
| Borate | 2.50 |
| Calcium chloride | 0.02 |
| Soil release agent | 0.45 |
| Brightener | 0.15 |
| Chelant | 1.00 |
| Ethanol | 1.00 |
| Propanediol | 11.00 |
| Monoethanolamine | 9.50 |
| Potassium hydroxide | 1.50 |
| Sodium hydroxide | 1.80 |
| Minors and water | up to 100% |

(1) Termamyl ® is a commercially available amylase.

A premix comprising a portion of the potassium sulphite and the Termamyl® is prepared by intimately mixing 99.8 g of Termamyl which comes as a liquid raw material) with 0.2 g of $K_2SO_3$ powder until the $K_2SO_3$ powder is dissolved into the liquid enzyme raw material. The odor is generated instantaneously. Said premix of Termamyl® and potassium sulphites is mixed gently in an open container. After 48 hours, the odor generated as both ingredients were contacted disappears.

0.15 g of said premix is then added to the total remainder of said detergent composition (which includes the remainder of potassium sulphite) by gently mixing both in a beaker at room temperature.

The liquid detergent composition described above was thus generated and exhibited no odor deviation. For comparison, the same detergent composition was manufactured where the enzyme preparation was added without having been premixed with the sulphiting agent. Under these conditions, a strong odor deviation was generated.

What is claimed is:

1. A process for the manufacture of a liquid detergent composition comprising a sulphiting agent and at least one liquid enzyme whereby said at least one enzyme and said sulphiting agent interact together so as to generate odors, characterized in that said process includes the steps of:

intimately mixing in liquid form said at least one enzyme and at least a portion of said sulphiting agent separately from the remainder of the liquid detergent composition so as to generate said odors outside the remainder of said liquid detergent composition, leaving said sulphiting agent and said at least one enzyme to interact until said odor has disappeared or is substantially reduced, and thereafter adding said intimate mixture of said sulphiting agent and said at least one enzyme to the remainder of the liquid detergent composition.

2. A process according to claim 1 wherein said sulphiting agent is potassium sulphite.

3. A process according to claim 1, wherein said intimate mixture comprises 0.1 to 5% by weight of the sulphiting agent.

4. A process according to claim 1, wherein said intimate mixture comprises 0.1 to 1% by weight of the sulphiting agent.

5. A process according to claim 1, wherein said intimate mixture consists essentially of the at least one enzyme and 0.1 to 5% by weight of the sulphiting agent.

6. A process according to claim 1, wherein said intimate mixture consists essentially of the at least one enzyme and the sulphiting agent.

7. A process according to claim 1 wherein the reduction of said odor is facilitated by mixing and aerating the intimate mix of enzyme and sulphiting agent.

8. A process according to claim 1 wherein said, enzyme includes protease, amylase, cellulase, lipase, or mixtures thereof.

9. A process according to claim 1 wherein said liquid detergent comprises from 0.1 to 10% by weight of the enzyme.

* * * * *